United States Patent [19]

Campbell

[11] Patent Number: 4,721,156

[45] Date of Patent: Jan. 26, 1988

[54] WELL CLEAN OUT APPARATUS

[76] Inventor: John F. Campbell, Rte. 2, Box 11-C, Youngsville, La. 70592

[21] Appl. No.: 33,663

[22] Filed: Apr. 3, 1987

[51] Int. Cl.[4] ..... E21B 37/00

[52] U.S. Cl. ..... 166/99; 166/301; 166/105.3; 166/109; 166/110

[58] Field of Search ..... 166/99, 301, 169, 162, 166/165, 170, 105.1, 105.3, 109, 110

[56] References Cited

U.S. PATENT DOCUMENTS

| | | | |
|---|---|---|---|
| 1,327,583 | 1/1920 | Arbon | 166/105.3 |
| 2,099,877 | 11/1937 | Westall | 166/109 |
| 2,141,672 | 12/1938 | Taylor | 166/109 |
| 2,166,488 | 7/1939 | Gates | 166/109 |
| 2,168,729 | 8/1939 | Cavins | 166/110 |
| 2,331,631 | 10/1943 | Rogers et al. | 166/109 |
| 3,003,562 | 10/1961 | Yates | 166/99 X |
| 3,406,757 | 10/1968 | Baumstimler | 166/99 |
| 4,190,113 | 2/1980 | Harrison | 166/311 |
| 4,421,182 | 12/1983 | Moody et al. | 175/65 |
| 4,478,285 | 10/1984 | Caldwell | 166/99 X |
| 4,493,383 | 1/1985 | Williams et al. | 175/234 |

*Primary Examiner*—Stephen J. Novosad
*Attorney, Agent, or Firm*—John D. Jeter

[57] ABSTRACT

A well clean out apparatus of the reciprocating pump, recirculating, type has two debris entrapment chambers below and one fluid chamber above the pump. The pump piston has a stack of flat washers to function as piston packing. The washers are axially and radially loose fitting to allow some movement to enable particles to work past each washer to avoid sand jamming. The washer stack, collectively, resists fluid by-pass around the piston. The pump is inverted and fluid flows through the piston rod to increase fluid velocity in the piston vicinity.

9 Claims, 2 Drawing Figures

WELL CLEAN OUT APPARATUS

The present invention pertains to well clean out tools of the type used to remove sand and other debris from the bottom of wells.

EXISTING ART

Well clean out tools used to remove sand and other debris from the bottom of wells may be run into the well bore supported by wire lines or pipe strings extending from the earth surface. In both cases, the top end of the clean out tool is usually reciprocated axially in the well and relative to the lower end of the tool to pump fluid and debris into the tool. The tools commonly have debris entrapment chambers in the tool to hold debris while cleaner fluid moves upward through the tool to be circulated back to the well bore through openings near the tool upper end. The circulation of fluid through the tool will continue until the debris is satisfactorily removed from the well. The clean out tool may have to make several trips into and out of the well to be emptied of debris at the surface. The tubing string used for production is commonly removed form the well for clean out operations.

Current clean out tool art is typified by the following U.S. patents.

1. U.S. Pat. No. 4,493,383, to Williams and Davis, Jan. 15, 1985.
2. U.S. Pat. No. 4,478,285, to Donald Caldwell, Oct. 23, 1984.
3. U.S. Pat. No. 4,421,182, Moody and Moody, Dec 20, 1983 and
4. U.S. Pat. No. 4,190,113, to W. Harrison, Feb. 26, 1980.

The existing tools have problems with pump elements becoming sand jammed, requiring an excessive round trip out of the well to clean sand from the pumps. The low fluid velocity in the vicinity of the pump elements is believed to contribute to the jamming problem. The arrangement of the pump elements may also contribute to the tendency to jam because sand and other particulates may not be able to negotiate the piston clearances.

Removal of the production tubing from the well for clean out operations is additionally a costly operation that the industry needs to avoid.

A clean out tool is needed that can be run into the well inside a production tubing string. Better control of debris particles, in the vicinity of pump elements is needed to avoid sand jamming. Piston assemblies that are prone to sand jamming need to be rearranged to allow small quantities of sand to negotiate the piston clearances.

It is therefore an object of this invention to provide apparatus that will operate in the production tubing string and be transportable downhole along the tubing string bore, for well clean out operations.

It is another object of this invention to provide apparatus with pump configurations and fluid velocity relationships that will avoid sand jamming.

It is still a further object of this invention to provide clean out tools with pump piston arrangements that will allow sand particles that enter the piston clearances to work their way out of the clearances to avoid sand jamming.

These and other objects, advantages, and features of this invention will be apparent to those skilled in the art from a consideration of the specification, including the attached claims and appended drawings

SUMMARY OF THE INVENTION

A reciprocating pump-type well clean out tool that can be run down hole through the bore of production tubing string. The pump is arranged to increase the relative velocity of fluid moving through the pump area to reduce the amount of sand that tends to settle and jam the pump. The liquid pumped through the tool is vented from the top of the tool to the bore of the tubing string to be recirculated. The packing of the pump piston is a stack of loosely fitted washers that may move both axially and transversely to allow particles to work out of the piston without jamming. The washers, collectively provide fluid packing for the piston to reduce the by-pass of fluid around the piston. There are two debris entrapment chambers below the pump and one check-valved fluid chamber above the pump.

DETAILED DESCRIPTION OF DRAWINGS

Figure 1A:
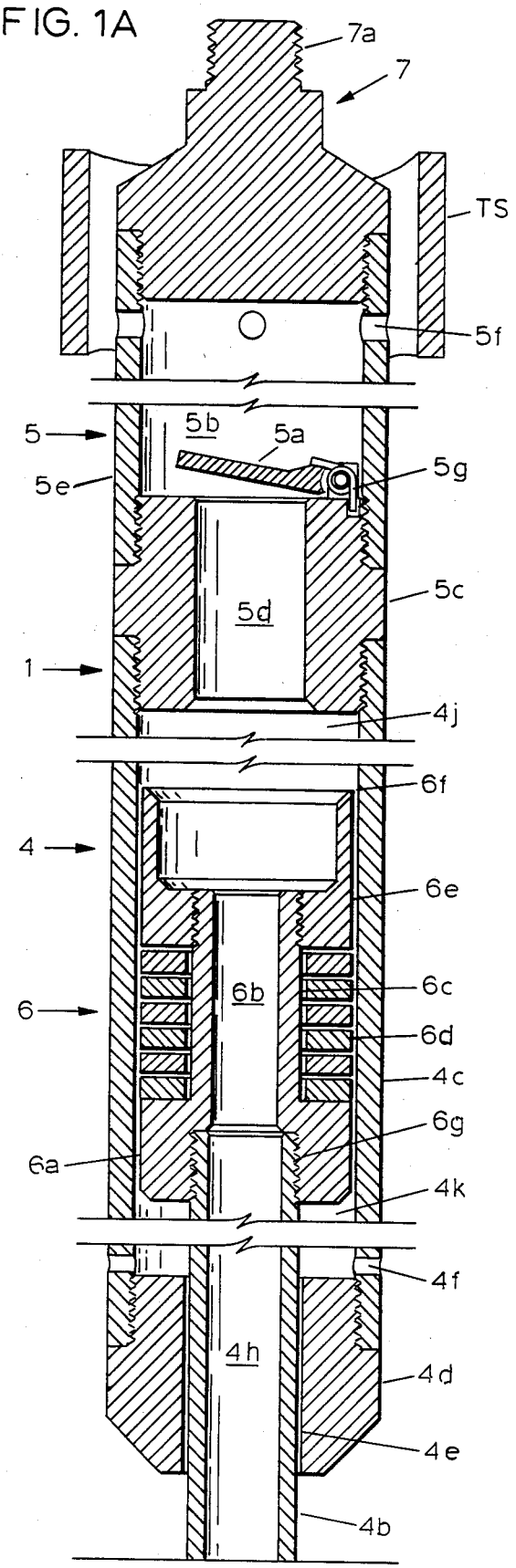
FIG. 1A is a wide elevation, in cut-away, of the upper end of the apparatus of the invention.
Figure 1B:
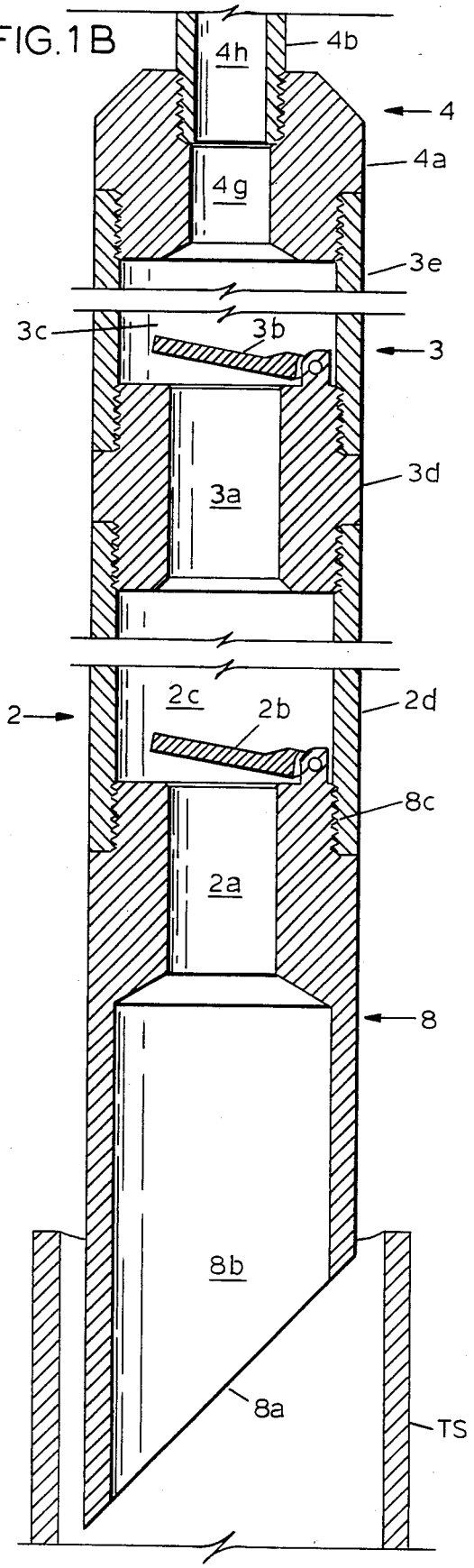
FIG. 1B is a side elevation, in cut-away, of the lower end of the apparatus of the invention.

In the drawings wherein like reference characters are used throughout for like parts, FIGS. 1A and 1B are mutual continuations with FIG. 1A being the upper part of the whole. A pipe string, usually the production tubing string, TS, extends from the earth surface to the lower reaches of the well. The tubing string is commonly removed from the well but for this disclosure it is part of the apparatus and is in place in the well. The overall apparatus will include the tubing string and the rest of the assembly run into the tubing string bore will be referred to as the clean out tool. Operation of the clean out tool will involve a manipulation means, usually a wire line extending from the surface down through the tubing string bore and is attached to the top of the clean out tool. The wire line and it's lower terminal which attaches to the clean out tool is not shown but is well established in the art and fimiliar to those skilled in the art.

A wire line terminal (not shown) is threadedly attached to the threaded end 7*a* of the terminal 7 of the clean out tool. The elongated, generally tubular, body 1 is sized to be lowered through the tubing string bore from the surface to the part of the well to be cleaned out.

When ready for operation, the lower end of the tool, usually bridge breaker 8, will be supported by debris in the well or the lower end of the tubing string. The wire line supporting the upper end of the body will be reciprocated up and down to cause a pumping action, to be described later. The pumping action ingests debris laden fluid into opening, or inlet, 8*b*. The fluid flows upward through the debris chambers, where most of the debris remains, and up through the pump into a fluid chamber and out holes through the well of the tool into the bore of the tubing string. The fluid is recirculated through the tool to entrain and trap more debris.

During the up stroke of the upper end of the tool fluid and debris enters inlet 8*b*, flows through bore 2*a*, check valve 2*b*, debris chamber 2*c*, bore 3*a*, check valve 3*b*, debris chamber 3*c*, bores 4*g*, 4*h* and 6*b* and into fluid chamber 4*j*. Check valve 5*a* is closed. On the down stroke of the upper part of the tool, check valves 2*b* and 3*b* are closed and fluid displaced by the axially shrinking chamber 4*j* moves up through bore 5*d*, check valve 5*a*, fluid chamber 5*b* and out holes 5*f* into the bore of the tubing string. During the down stroke, debris settles out in chambers 2*c* and 3*c*. Piston 6 moves a short distance in tube 4*c* relative to the length of debris chambers 2*c* and 3*c* and the constantly settling debris in these chambers results in relatively clean fluid moving upward through the piston bore 6*b* and into fluid chamber 4*j*.

The clean out tool body includes an upper terminal 7, a lower terminal that is either bridge breaker 8 or the equivalent of the upper end of bridge breaker 8, and four elongated, generally tubular subs threadedly joined end-to-end.

The first sub includes tube 2*d*, check valve 2*b* and debris chamber 2*c*. The bridge breaker tool is adapted at the top, by threaded end 8*c*, to support check valve 2*b* and to form the lower end of chamber 2*c*.

The second sub includes coupling 3*d*, debris chamber 3*c*, tube 3*e* and check valve 3*b*.

The third sub is a pumping sub and has an upper portion and a lower portion. The upper portion includes tube 4*c* and bore reduction element 4*d*. The lower portion includes coupler 4*a* and upwardly extending tubular extension 4*b*. Piston 6 is separately described but could be considered part of the lower portion of the third sub to which it is threadedly attached.

The fourth sub includes coupler 5*c*, with bore 5*d* and check valve 5*a*, fluid chamber 5*b*, and tube 5*e* with holes 5*f* near the top. Upper terminal 7 can be considered part of the fourth sub since it provides closure for the top of tube 5*e*.

Piston 6 is a novel arrangement which avoids the usual problems of sand binding, or jamming, of the piston in the cooperating bore of tube 4*c*. Piston core 6*a* is threadedly attached by threads 6*g* to extension 4*b*. The piston core has the tubular arbor 6*c* extending upward to confine washers 6*d*. The stack of washers 6*d* are confined by silt cup 6*e*. The silt cup, or debris cup, 6*e* has a soft nosed set screw (not shown) which locks the cup to the arbor to prevent relative rotation when the silt cup is axially adjusted on the arbor. Proper adjustment allows the washers some axial free movement. The washers 6*d* have some radial clearance on arbor 6*c* and also within the bore of tube 4*c* so that they can individually move somewhat to allow debris particles that the washers encounter to move past each washer, in turn, to avoid jamming.

On the upstroke of the upper end of the body, fluid drawn into chamber 4*j* is at a lower pressure than fluid in chamber 4*k* and this causes some leakage around the piston perimeter. This leakage is cleaner than fluid flowing along bore 4*h* due to the settling of particles in chamber 4*k*. On the upstroke, settled particles are ejected from holes 4*f*. The piston is somewhat protected from particle intrusion from below.

On the down stroke of the upper end of the body, or upper end of the third sub, valve 5*a* is open and fluid flows freely to and out of holes 5*f* and there is little pressure difference across the piston. This helps prevent particle intrusion into the piston clearances. There are always some particles in chamber 4*j* and, given time, they will settle to the top of the piston. Debris cup 6*e* has an upwardly opening cup with reasonably sharp ends 6*f* in the vicinity of the well of the bore of tube 4*c*. Most of the settling particles enter the cup rather than the clearances between the piston and the cooperating bore. On the next upstroke, the particles in the cup and in bore 6*b* and 4*h* will be moved upward into chamber 4*j* with relatively high velocity caused by the small size of bore 6*b*. The resulting fluid turbulence will mix the debris and entrain it upward to be expelled through holes 5*f*.

The bridge breaking aspect of element 8 is the chisel shape on the lower end made by plane 8*a* which cuts the tubular end. The angle shown is forty-five degrees. The bridge breaker can be any shape but is selected in view of the type of debris and debris consolidation to be expected in the well. The only change usually required is the angle of plane 8*a*.

The clean out tool body may be quite long and any number of tube lengths may be joined by couplers to make up the length preferred. The couplers are usually in the tubes making up debris chambers 2*c* and 3*c*. The couplers resemble 3*d* with no check valve and the coupler bores are usually larger than 2*a* and 3*a*. The couplers, if used, do not influence function and none are shown.

In especially slim hole wells, the well casing can provide the radial support needed by the tool. The novel tool and piston arrangement offers advantage in such applications and such use is anticipated by and is within the scope of the claims.

Flap type check valves are well established in the art and are purchase items. The valves can be purchased with torsion springs that urge the valve closed. The common spring is a torsion spring that makes bout one turn around the valve flap hinge pin and engages the valve flap and a stationary element associated with the tool structure.

From the foregoing, it will be seen that this invention is one well adapted to attain all of the ends and objects hereinabove set forth, together with other advantages which are obvious and which are inherent to the method and apparatus It will be understood that certain features and subcombinations are of utility and may be employed without reference to other features and subcombinations. This is contemplated by and is within the scope of the claims.

As many possible embodiments may be made of the apparatus and method of this invention without departing from the scope thereof, it is to be understood that all matter herein set forth or shown in the accompanying drawings is to be interpreted as illustrative and not in a limiting sense.

The invention having been described, I claim:

1. A well clean out apparatus, comprising:

a pipe string, having an upper end and a lower end, adapted to be received and supported in a well;

an elongated, generally tubular, body having an upper end and a lower end, adapted to be lowered from the surface to the well clean out depth through the bore of said pipe said elongated body comprising a plurality of subs threadedly coupled together in an end-to-end relationship;

a first sub near said lower end of said body, said first sub having an inlet for receiving fluid and debris from the bore of said pipe string, a check valve near said inlet oriented to allow upward flow and prevent downward flow, and a debris chamber above said check valve;

a second sub arranged above said first sub, with a check valve neas tthe lower end oriented to allow upward flow and to prevent downward flow, and a debris chamber above said check valve;

a third sub arranged above said second sub, said third sub comprising an upper portion and a lower portion, said two portions arranged for a telescoping relationship, said lower portion having an upwardly extending generally tubular extension adapted at the upper end for the attachment of a piston, said upper portion arranged to receive a piston and said tubular extension, and having a reduced bore at the lower end to retain said piston in said upper portion;

a piston attached to the upper end of said tubular extension of said third sub, situated in the bore of said upper portion of said third sub to function as a pump;

a fourth sub arranged above said third sub, said fourth sub having a check valve near the lower end arranged to allow upward flow and prevent downward flow, a fluid chamber above said check valve, holes near the top of said fluid chamber arranged to allow fluid flow from said fluid chamber to the bore of said pipe string;

lower attachment means at the lower end of said first sub to receive a debris cutting tool;

upper attachment means at the top of said fourth sub to receive a coupling terminal of a clean out tool suspension means.

2. The apparatus of claim 1 wherein said piston comprises, a core adapted for attachment to said tubular extension, a cylindrical length of reduced diameter, a plurality of piston ring washers with loose fitting bores arranged on said cylindrical length, a piston end secured to said cylindrical length to retain said washers and to allow said washers some axial free movement, said washers having an outer diameter to loosely fit in the bore of said upper portion of said third sub, and a bore extending axially through said core.

3. The apparatus of claim 2 further providing that said piston end comprise a debris cup means opening upwardly, with an upper rim near and adjacent the wall of the bore of said upper portion of said third sub.

4. The apparatus of claim 1 further providing vent holes through the wall of said upper portion of said third sub near the reduced bore to vent fluid to and from the annular space below said piston.

5. The apparatus of claim 1 further providing a debris cutter tool attached to the lower end of said first sub and extending downward, said debris cutter tool having a bore to serve as an extension of said inlet to said first sub.

6. A well clean out tool, including:

an elongated, generally tubular, body with an upper end and a lower end, said body comprising a plurality of subs threadedly coupled together with an end-to-end relationship;

a first sub near the lower end of said body, said first sub having an inlet for receiving fluid and debris from the well, a check valve near said inlet oriented to allow upward flow and prevent downward flow, and a debris chamber above said check valve;

a second sub arranged above said first sub, with a check valve near the lower end, oriented to allow upward flow and prevent downward flow, and a debris chamber above said check valve;

a third sub arranged above said second sub, said third sub comprising an upper portion and a lower portion, said two portions arranged for a telescoping relationship, said lower portion having an upwardly extending, generally tubular, extension adapted at the upper end for attachment of a piston, said upper portion arranged to receive said piston and said tubular extension, and having a reduced bore at the lower end to retain said piston in said upper portion;

a piston attached to the upper end of said tubular extension of said third sub, situated in the bore of said upper portion of said third sub to function as a pump, said piston comprising a piston core adapted to axially and radially confine a stacked plurality of washers on said core for limited axial and radial free movement, a plurality of washers on said piston, each washer having an outer diameter that loosely fits in the bore of the upper portion of said third sub;

a fourth sub arranged above said third sub, said fourth sub having a check valve near the lower end arranged to allow upward flow and to prevent downward flow, a fluid chamber above said check valve, and holes near the top of said fluid chamber arranged to allow fluid flow from said fluid chamber to the well;

lower attachment means at the lower end of said first sub to receive a debris cutting tool;

upper attachment means at the top of said fourth sub to receive a coupling terminal of a clean out tool suspension means.

7. The well clean out tool of claim 6 further providing that said piston, at the top, have an upwardly opening debris cup, said cup having an upper tubular lip with an outer diameter near to and adjacent the wall of the bore of the upper portion of said third sub.

8. The well clean out tool of claim 6 further providing vent holes through the wall of said upper portion of said third sub above and near said reduced bore to vent fluid below said piston.

9. A well clean out tool, including:

an elongated generally tubular body having an upper end and a lower end and a telescoping intermediate section, said intermediate section having a piston and cooperating bore to serve as a pump, said pump achieving a pumping action when the upper end of said body is axially reciprocated relative to said lower end of said body;

a piston situated in said body, said piston comprising, a core, a stack of a plurality of piston ring washers axially and transversely confined, on said core, for limited axial and transverse movement relative thereto, said washers having an outer diameter which allows some transverse movement relative to a cooperating bore, to allow particles that enter clearances between piston and cooperating bore to work past the loose washers.

* * * * *